US008317288B2

(12) United States Patent
Nakamura

(10) Patent No.: US 8,317,288 B2
(45) Date of Patent: Nov. 27, 2012

(54) LIQUID DISCHARGE APPARATUS

(75) Inventor: Hirotake Nakamura, Nagoya (JP)

(73) Assignee: Brother Kogyo Kabushiki Kaisha, Aichi-ken (JP)

( * ) Notice: Subject to any disclaimer, the term of this patent is extended or adjusted under 35 U.S.C. 154(b) by 312 days.

(21) Appl. No.: 12/728,512

(22) Filed: Mar. 22, 2010

(65) Prior Publication Data

US 2010/0245437 A1 Sep. 30, 2010

(30) Foreign Application Priority Data

Mar. 27, 2009 (JP) ..... 2009-079815

(51) Int. Cl.
*B41J 29/38* (2006.01)

(52) U.S. Cl. ..... 347/14

(58) Field of Classification Search ..... None
See application file for complete search history.

(56) References Cited

U.S. PATENT DOCUMENTS

| | | | | |
|---|---|---|---|---|
| 2002/0118249 | A1* | 8/2002 | Kageyama | 347/37 |
| 2005/0219282 | A1 | 10/2005 | Kachi | |
| 2009/0128595 | A1* | 5/2009 | Komamiya et al. | 347/14 |

FOREIGN PATENT DOCUMENTS

| | | |
|---|---|---|
| JP | 5-220947 | 8/1993 |
| JP | 6-286125 | 10/1994 |
| JP | 2002-036599 | 2/2002 |
| JP | 2002-316423 | 10/2002 |
| JP | 2005-280246 | 10/2005 |

* cited by examiner

*Primary Examiner* — Stephen Meier
*Assistant Examiner* — Tracey McMillion
(74) *Attorney, Agent, or Firm* — Frommer Lawrence & Haug LLP

(57) ABSTRACT

A liquid discharge apparatus which discharges a liquid in each of continuing discharge opportunities includes: a discharge head discharging the liquid from nozzles; a controller controlling the discharge head to discharge the liquid from the nozzles; a duty detecting section detecting a value of a duty which is a ratio of a discharge amount of the liquid discharged from the discharge head with respect to a maximum discharge amount of the liquid to be discharged from the discharge head in each of the discharge opportunities; and a wait time determining section determining whether a wait time, in which the liquid is not discharged, is provided after each of the discharge opportunities, based on the values of the duties detected by the duty detecting section in past continuing discharge opportunities including the last discharge opportunity.

13 Claims, 5 Drawing Sheets

LIQUID DISCHARGE APPARATUS

CROSS REFERENCE TO RELATED APPLICATION

The present application claims priority from Japanese Patent Application No. 2009-079815 filed on Mar. 27, 2009, the disclosures of which are incorporated herein by reference in their entirety.

BACKGROUND OF THE INVENTION

1. Field of the Invention

The present invention relates to a liquid discharge apparatus for discharging a liquid from nozzles.

2. Description of the Related Art

In an ink-jet recording apparatus described in Japanese Patent Application Laid-open No. 5-220947, an ink is discharged from an ink-jet recording head which is reciprocatively moved in the scanning direction together with a carriage, to the recording paper which is transported in the direction perpendicular to the scanning direction. The wait time is determined in accordance with a value of the duty which is a ratio of an amount of the actually discharged ink with respect to a maximum ink discharge amount to be discharged from the ink jet recording head in the recording of the last one line (operation for discharging the ink from the ink-jet recording head while moving the ink-jet recording head from one end to the other end of the printing range in the scanning direction). After the recording is completed for the last one line, the ink jet recording head is allowed to wait for the determined wait time, and then the recording is started for the next one line.

After that, the recording of the next one line is started. Accordingly, the recording of the next one line is started after the ink, which is in the amount necessary for the ink jet recording head, is supplied. The supply shortage of the ink is avoided in the ink jet recording head.

SUMMARY OF THE INVENTION

In the case, when the ink is discharged from the ink-jet recording head, the ink, which is in the same amount as that of the discharged ink, is newly supplied to the ink-jet recording head. However, the ink, which is in the same amount as that of the discharged ink, is not supplied instantaneously when the ink is discharged, due to the flow passage resistance which is determined by the viscosity of the ink and the cross-sectional area and the length of the ink flow passage. That is, the time difference arises between the discharge of the ink and the supply of the ink in the same amount as that of the discharged ink.

When the ink is discharged from the ink-jet recording head, the negative pressure of the ink is increased in the ink flow passage of the ink-jet recording head. The negative pressure is decreased by the supply of the ink. However, if the ink is continuously discharged from the ink-jet recording head, for example, when the value of the duty is large, then the supply of the ink to the ink-jet recording head is in shortage, and the negative pressure of the ink is continuously increased without any decrease. As a result, the meniscus is destroyed in the nozzle, the air flows into the ink flow passage from the nozzle, and it becomes impossible to normally discharge the ink from the nozzle. The negative pressure of the ink herein means the fact that the pressure of the ink is a pressure lower than the atmospheric pressure.

In the ink-jet recording apparatus described in Japanese Patent Application Laid-open No. 5-220947, even when the value of the duty is large in the recording of the last one line, the situation, in which the ink is immediately exhausted from the ink-jet recording head and it becomes impossible to discharge the ink, is not actually caused. For example, when the recording, in which the value of the duty is large, is continued, then the negative pressure of the ink is gradually increased in the ink flow passage of the ink-jet recording head, the air eventually flows into the ink flow passage from the nozzle, and it becomes impossible to discharge the ink. In other words, the negative pressure of the ink in the ink-jet recording head is not determined by only the value of the duty in the recording of the last one line, but the negative pressure also depends on the value of the duty in the recording of more previous line or lines.

Therefore, if the wait time is determined in accordance with only the value of the duty in the recording of the last one line, it is necessary that the wait time should be determined to be relatively long in order to reliably avoid the ink supply shortage, irrelevant to any value of the duty in the recording of more previous line or lines.

However, if the wait time is determined to be relatively long as described above, any unnecessary wait time is consequently provided when the values of the duties in the recordings of lines before the recording of the last one line are small. Accordingly, it is feared that the printing speed may be lowered.

An object of the present invention is to provide a liquid discharge apparatus which makes it possible to suppress the decrease in the operation speed as far as possible while avoiding the supply shortage of a liquid to be supplied to a liquid discharge head.

According to a first aspect of the present invention, there is provided a liquid discharge apparatus which discharges a liquid in each of a plurality of continuing discharge opportunities, the liquid discharge apparatus including: a liquid discharge head which discharges the liquid from a plurality of nozzles; a controller which controls the liquid discharge head to discharge the liquid from the plurality of nozzles; a duty detecting section which detects a value of a duty which is a ratio of a discharge amount of the liquid discharged from the liquid discharge head with respect to a maximum discharge amount of the liquid to be discharged from the liquid discharge head in each of the discharge opportunities; and a wait time determining section which determines whether or not a wait time, in which the liquid is not discharged, is provided after each of the discharge opportunities, and: the wait time determining section determines whether or not the wait time is provided based on the values of the duties which are detected by the duty detecting section in past continuing discharge opportunities including the last discharge opportunity; and the controller controls the liquid discharge head to wait for the wait time after the last discharge opportunity when the wait time determining section determines that the wait time is to be provided.

Accordingly, it is determined whether or not the wait time is provided based on the values of the duties in the past continuing discharge opportunities which include the last discharge opportunity. Thus, if the necessary amount of the liquid is not supplied to the liquid discharge head, then the wait time is provided, and the liquid discharge operation can be performed after giving such a state that the necessary amount of the liquid is supplied to the liquid discharge head. Accordingly, it is possible to avoid the supply shortage of the liquid to be supplied to the liquid discharge head. Further, the wait time can be provided only when the necessary amount of the liquid is not supplied to the liquid discharge head. Any unnecessary wait time is not provided. It is possible to suppress the decrease in the operation speed of the liquid discharge apparatus as far as possible.

According to a second aspect of the present invention, there is provided a liquid discharge apparatus which discharges a liquid in each of a plurality of continuing discharge opportunities, the liquid discharge apparatus including: a liquid discharge head which discharges the liquid from a plurality of nozzles; a controller which controls the liquid discharge head to discharge the liquid from the plurality of nozzles; a duty detecting section which detects a value of a duty which is a ratio of a discharge amount of the liquid discharged from the liquid discharge head with respect to a maximum discharge amount of the liquid to be discharged from the liquid discharge head in each of the discharge opportunities; and a wait time determining section which determines a wait time, in which the liquid is not discharged, to be a first wait time or a second wait time which is not shorter than zero and shorter than the first wait time after each of the discharge opportunities, and the wait time determining section determines the wait time to be the first wait time or the second wait time based on the values of the duties which are detected by the duty detecting section in past continuing discharge opportunities including the last discharge opportunity; and the controller controls the liquid discharge head to wait for the wait time determined by the wait time determining section after the last discharge opportunity when the wait time determining section determines the wait time.

DESCRIPTION OF THE PREFERRED EMBODIMENTS

A preferred embodiment of the present invention will be explained below.

Figure 1:
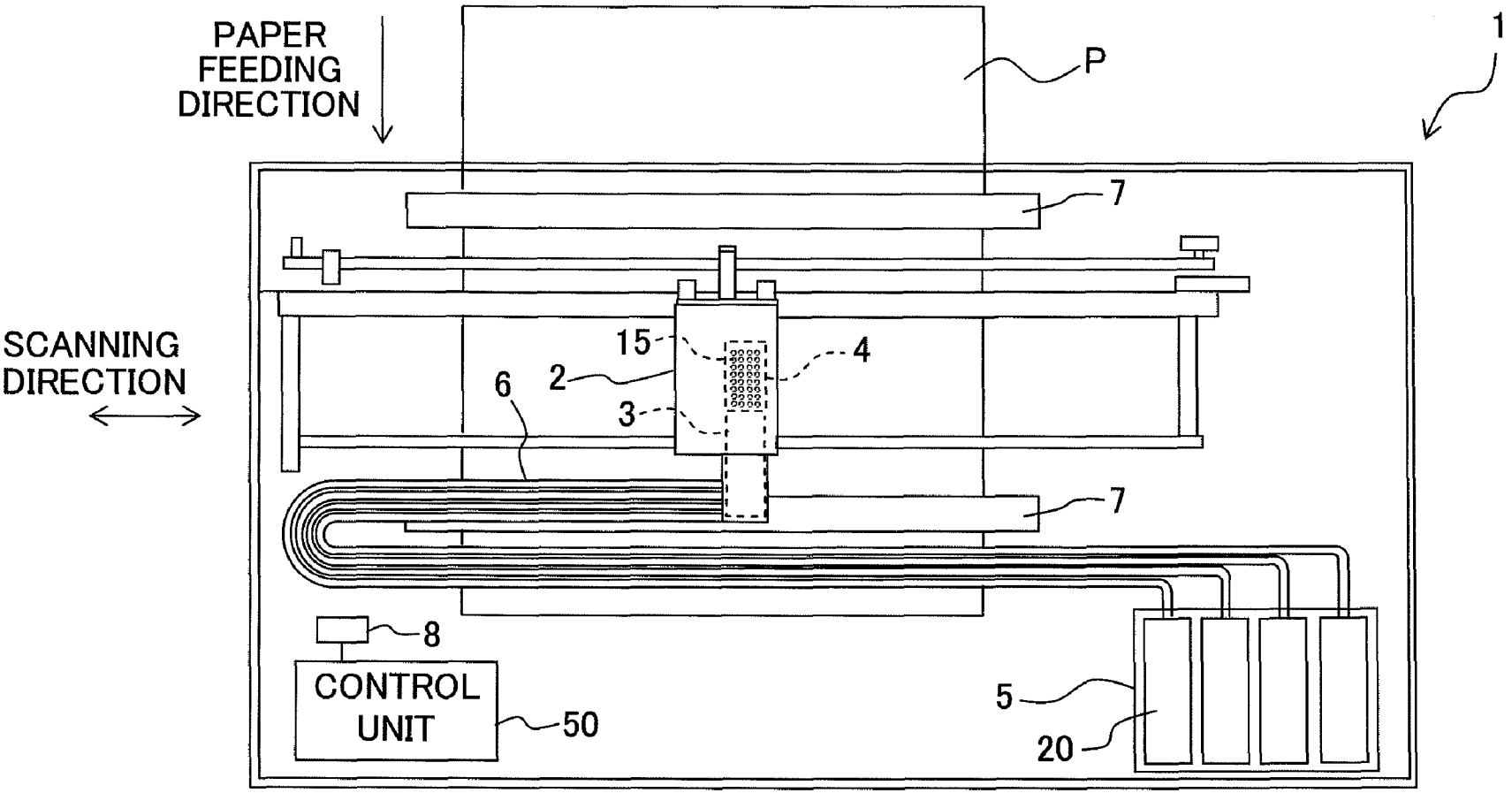
FIG. 1 shows a schematic arrangement of a printer according to an embodiment of the present invention.

As shown in FIG. 1, a printer 1 (liquid discharge apparatus) includes, for example, a carriage 2 (moving section), subtanks 3, an ink jet head 4 (liquid discharge head), a cartridge attachment section 5, tubes 6, transport rollers 7, and a temperature detecting unit 8 (temperature detecting section). The operation of the printer 1 is controlled by a control unit 50 (controller). FIG. 1 shows nozzles 15 of the ink-jet head 4 described later on while being magnified.

The carriage 2 is reciprocatively movable in the left-right direction as shown in FIG. 1 (scanning direction). The subtank 3 is formed with a casing which is composed of, for example, a resin having an opening and a flexible film which closes the opening. The subtanks 3 are attached onto the carriage 2. The ink-jet head 4 is arranged on the lower surfaces of the subtanks 4. Inks are supplied from the subtanks 3, and the inks are discharged from the plurality of nozzles 15 formed on the lower surface thereof.

The cartridge attachment section 5 is arranged at a lower-right end portion of the printer 1 as viewed in FIG. 1. Four ink cartridges 20, into which the inks of black, yellow, cyan, and magenta to be discharged from the ink-jet head 4 are charged respectively, can be attached/detached with respect to the cartridge attachment section 5.

The tubes 6 connect the subtanks 3 and the cartridge attachment section 5. In particular, first ends of the tubes 6 are connected to left side surfaces of lower end portions of the subtanks 3 as viewed in FIG. 1, and the tubes 6 extend in the leftward direction from connecting portions with respect to the subtanks 3. Further, the tubes 6 are bent by about 180° at intermediate portions to extend in the rightward direction, and second ends thereof are connected to the cartridge attachment section 5 (ink cartridges 20). The inks, which are contained in the ink cartridges 20 attached to the cartridge attachment section 5, are supplied to the ink jet head 4 via the tubes 6 and the subtanks 3. The inks, which are supplied from the ink cartridges 20 to the subtanks 3, suffer the pressure fluctuation when the inks are discharged from the ink-jet head 4 and/or when the carriage 2 is reciprocatively moved as described later on. However, the pressures thereof are attenuated or damped owing to the damper effect brought about by the flexible films of the subtanks 3.

The transport rollers 7 are arranged at upper and lower positions with respect to the carriage 2 respectively to transport the recording paper P in the downward direction (paper feeding direction) as shown in FIG. 1. The temperature detecting unit 8 is a sensor which has a thermistor or the like and which is capable of detecting the temperature. The temperature detecting unit 8 detects the temperature in the printer 1, and a detection result is transmitted to the control unit 50. If the temperature change arises in the printer 1, the temperatures of the inks in the printer 1 are changed as well. That is, the temperature detecting unit 8 detects the temperature in the printer 1 which is in a certain relationship with respect to the temperatures of the inks. The position, at which the temperature detecting unit 8 is arranged, is not limited to the position shown in FIG. 1. It is enough that the temperature detecting unit 8 is arranged at any position at which it is possible to detect the temperature of any portion of the printer 1 having the certain relationship with respect to the temperatures of the inks. Alternatively, the temperature detecting unit 8 may directly detect the temperatures of the inks.

In the printer 1, the printing is performed on the recording paper P such that the inks are discharged from the ink-jet head 4 which is reciprocatively moved in the scanning direction together with the carriage 2, onto the recording paper P which is transported in the paper feeding direction (downward direction as viewed in FIG. 1) by the transport rollers 7. In particular, the printing is performed on the recording paper P such that a series of operations, wherein the operation (ink discharge operation) for discharging the inks from the ink-jet head 4 is performed a plurality of times during one pass as a discharge opportunity in which the ink jet head 4 is moved by a predetermined distance in the scanning direction from one end to the other end of the printing range, are repeatedly performed while transporting the recording paper P in the paper feeding direction.

Next, the ink jet head 4 will be explained.

Figure 2:
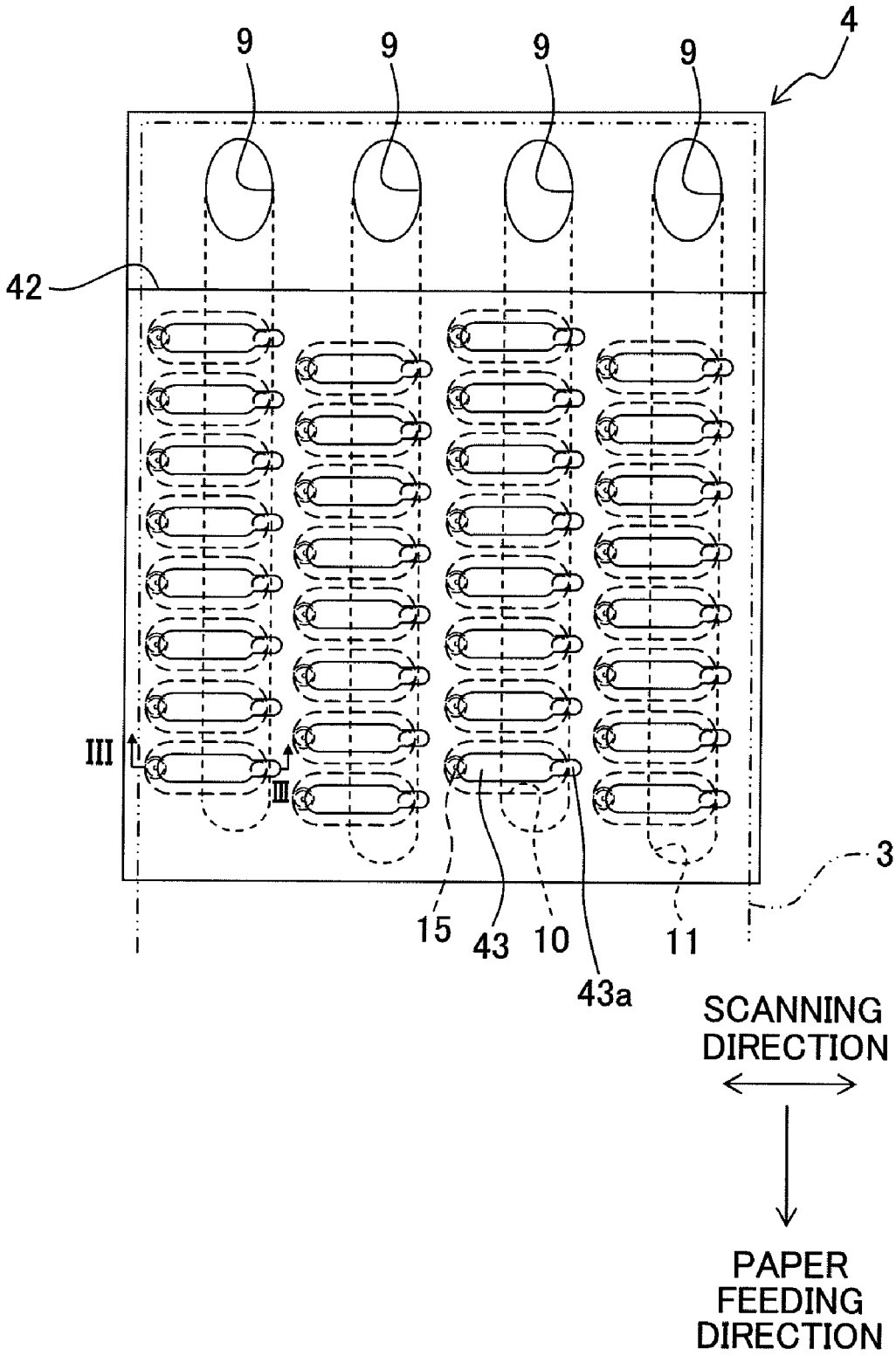
FIG. 2 shows a plan view illustrating an ink-jet head shown in FIG. 1.
Figure 3:
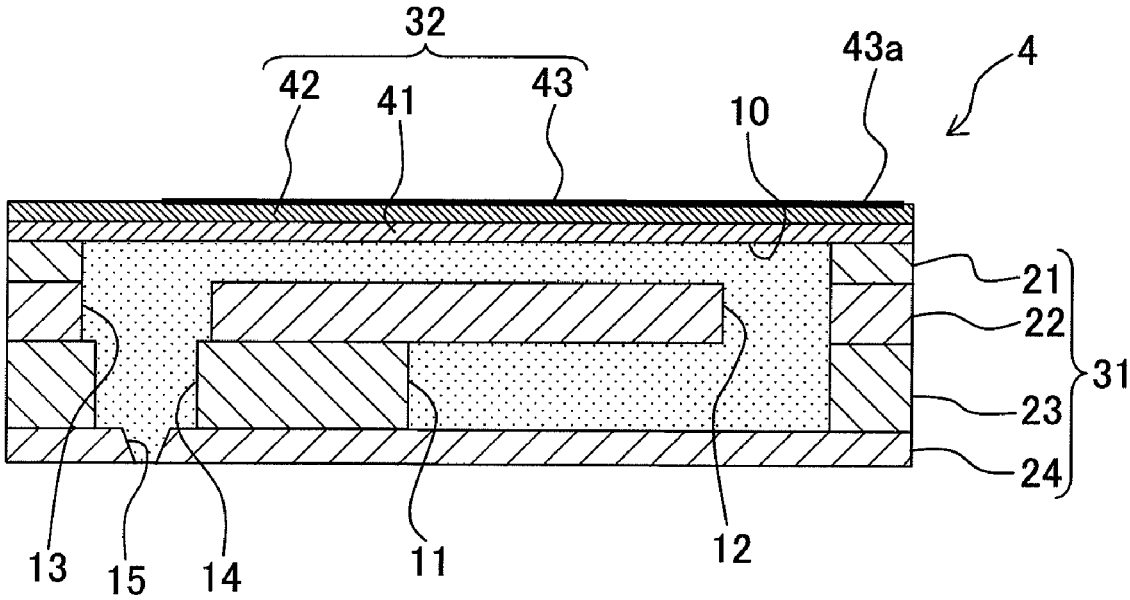
FIG. 3 shows a sectional view taken along a line III-III shown in FIG. 2.

As shown in FIGS. 2 and 3, the ink-jet head 4 is provided with a flow passage unit 31 which is formed with the ink flow passages including pressure chambers 10 and the nozzles 15, and a piezoelectric actuator 32 which is provided to apply the pressure to the inks contained in the pressure chambers 10.

The flow passage unit 31 is constructed by mutually stacking four plates of a cavity plate 21, a base plate 22, a manifold plate 23, and a nozzle plate 24. The three plates 21 to 23 except for the nozzle plate 24, which are included in the four plates 21 to 24, are composed of a metal material such as stainless steel or the like, and the nozzle plate 24 is composed of a synthetic resin material such as polyimide or the like. Alternatively, the nozzle plate 24 may be also composed of a metal material in the same manner as the other three plates 21 to 23.

The plurality of pressure chambers 10, each of which has a substantially elliptical planar shape having the longitudinal direction of the scanning direction, are formed for the cavity plate 21. The plurality of pressure chambers 10 are arranged in the paper feeding direction to form one array of the pressure chambers 10. Further, the arrays of the pressure chambers 10 as described above are arranged in four arrays in the scanning direction. A plurality of through-holes 12, 13, each of which has a substantially circular planar shape, are formed at portions of the base plate 22 opposed to the both end portions of the plurality of pressure chambers 10 in relation to the longitudinal direction as viewed in a plan view.

Manifold flow passages 11 are formed for the manifold plate 23. The manifold flow passages 11 are provided corresponding to the four arrays of the pressure chambers 10 described above. Each of the manifold flow passages 11 extends in the paper feeding direction to be opposed to substantially right halves of the plurality of pressure chambers 10 for constructing each of the arrays of the pressure chambers 10. The inks are supplied to the manifold flow passages 11 from four ink supply ports 9 which are provided at positions opposed to the upper end portions as viewed in FIG. 2 and which are connected to the subtanks 3. In particular, the inks of black, yellow, cyan, and magenta are supplied from the four ink supply ports 9 as referred to in this order starting from one arranged on the left side as shown in FIG. 2.

A plurality of through-holes 14, each of which has a substantially circular planar shape, are formed at portions of the manifold plate 23 opposed to the plurality of through-holes 13 as viewed in a plan view. The plurality of nozzles 15 are formed at portions of the nozzle plate 24 opposed to the through-holes 14 as viewed in a plan view. The plurality of nozzles 15 are arranged in the paper feeding direction to form one nozzle array thereby in the same manner as the pressure chambers 10. Further, the nozzle arrays as described above are arranged in four arrays in the scanning direction. The inks of black, yellow, cyan, and magenta are discharged from the plurality of nozzles 15 as referred to in this order starting from those which construct the nozzle array disposed on the left side as shown in FIG. 2.

In the flow passage unit 31, the manifold flow passages 11 are communicated with the pressure chambers 10 via the through-holes 12. Further, the pressure chambers 10 are communicated with the nozzles 15 via the through-holes 13, 14. In this way, the flow passage unit 31 is formed with the plurality of individual ink flow passages which extend from the manifold flow passages 11 via the pressure chambers 10 to arrive at the nozzles 15.

The piezoelectric actuator 32 is provided with a vibration plate 41, a piezoelectric layer 42, and individual electrodes 43. The vibration plate 41 is composed of a metal material such as stainless steel or the like. The vibration plate 41 is joined to the upper surface of the flow passage unit 31 so that the plurality of pressure chambers 10 are covered therewith. The conductive vibration plate 41 also functions as a common electrode in order to drive the piezoelectric actuator 32 as described later on. The vibration plate 41 is always retained at the ground electric potential.

The piezoelectric layer 42 is composed of a piezoelectric material containing a main component of lead titanium zirconate which is a mixed crystal of lead titanate and lead zirconate. The piezoelectric layer 42 is arranged continuously to range over the plurality of pressure chambers 10 on the upper surface of the vibration plate 41.

The plurality of individual electrodes 43 have substantially elliptical planar shapes which are one size smaller than those of the pressure chambers 10. The plurality of individual electrodes 43 are arranged respectively at portions opposed to the substantially central portions of the plurality of pressure chambers 10 on the upper surface of the piezoelectric layer 42. End portions of the plurality of individual electrodes 43, which are disposed on the side opposite to the nozzles 15 in relation to the longitudinal direction, extend to portions not opposed to the pressure chambers 10. Forward end portions thereof are connecting terminals 43*a*. The connecting terminals 43*a* are connected to driver IC 45 (see FIG. 4) via an unillustrated flexible wiring member (FPC). The driving electric potential is individually applied to the plurality of individual electrodes 43 by the driver IC 45.

The portions of the piezoelectric layer 42 described above, which are interposed between the plurality of individual electrodes 43 and the vibration plate 41 as the common electrode, are polarized in the thickness direction thereof.

An explanation will now be made about a method for driving the piezoelectric actuator 32. In the piezoelectric actuator 32, the plurality of individual electrodes 43 are previously retained at the ground electric potential by the driver IC 45. When the driving electric potential is applied to any one of the plurality of individual electrodes 43 by the driver IC 45, then the electric potential difference appears between the concerning individual electrode 43 and the vibration plate 41 as the common electrode which is retained at the ground electric potential, and the electric field, which is in the thickness direction that is the same as the polarization direction, is generated at the portion of the piezoelectric layer 42 interposed between the electrodes. Accordingly, the concerning portion of the piezoelectric layer 42 is shrunk in the horizontal direction perpendicular to the thickness direction. As a result, the vibration plate 41 and the piezoelectric layer 42 are deformed so that they are convex toward the pressure chamber 10 as a whole. In accordance with the deformation, the volume of the pressure chamber 10 is decreased, and the pressure of the ink contained in the pressure chamber 10 is raised. The ink is discharged from the nozzle 15 communicated with the pressure chamber 10.

Figure 4:
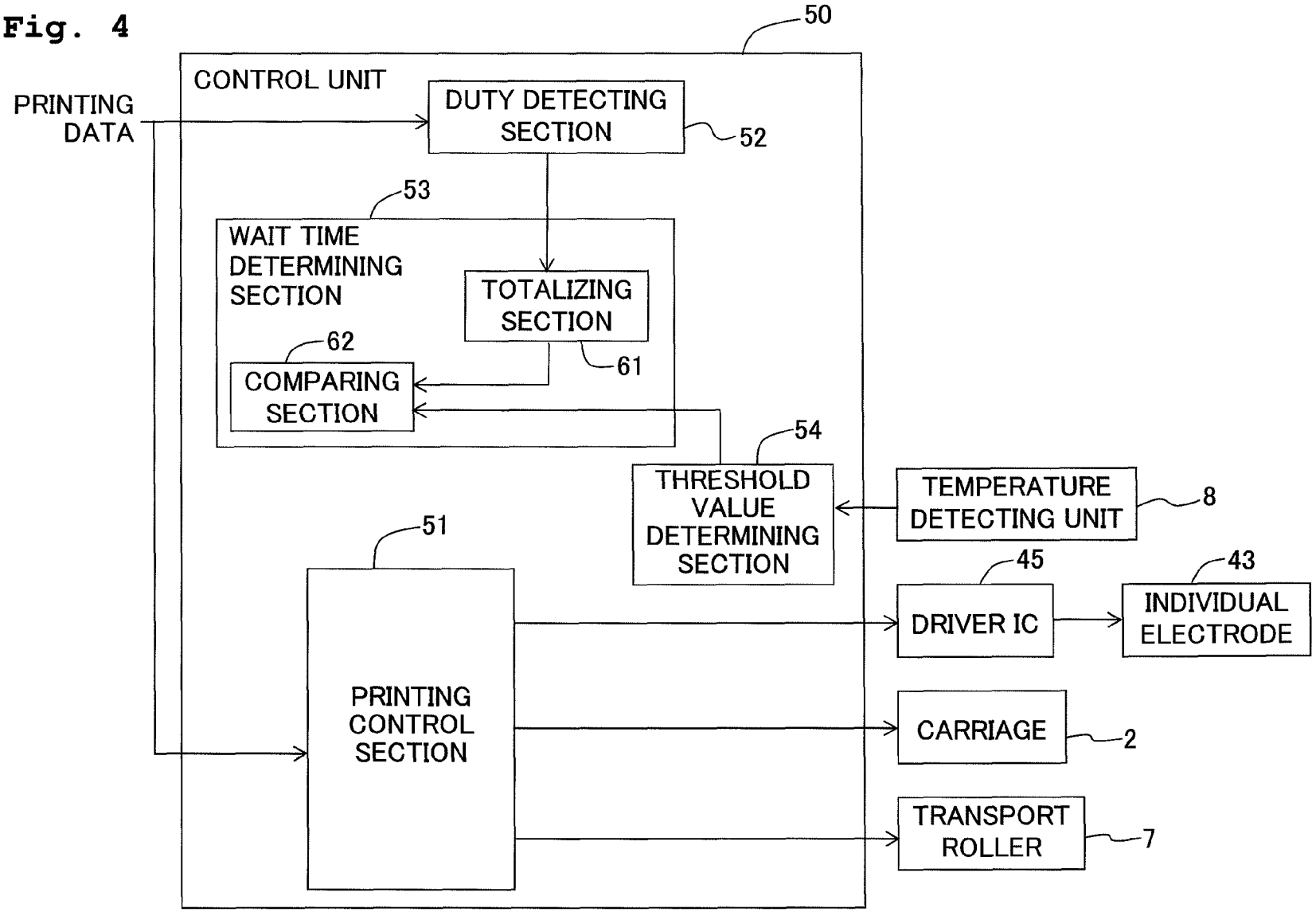
FIG. 4 shows a block diagram of a control unit shown in FIG. 1.

Next, an explanation will be made with reference to FIG. 4 about the control unit 50 which controls the operation of the printer 1. The control unit 50 includes, for example, CPU (Central Processing Unit), ROM (Read Only Memory), and RAM (Random Access Memory). These components function, for example, as a printing control section 51, a duty detecting section 52, a wait time determining section 53, and a threshold value determining section 54.

The printing data, which is provided for each pass to indicate, for example, the landing positions of the ink droplets on the recording paper P and the volumes of the ink droplets to be landed, is inputted into the printing control section 51, for example, from PC connected to the printer 1. The printing control section 51 controls the operations of the carriage 2 (specifically, for example, a motor for moving the carriage 2), the transport rollers 7 (specifically, for example, an unillustrated motor for rotating the transport rollers 7), and the driver IC 45 (ink-jet head 4) when the printing is performed in the printer 1 in accordance with the inputted printing data.

The duty detecting section 52 detects the duty in each of the passes from the printing data for each of the passes inputted into the printer 1 as described above. The term "duty" herein means the ratio of the amount of the actually discharged ink with respect to the maximum discharge amount of the ink to be discharged from the ink-jet head 4 in each of the passes (specifically, the ink discharge amount to be brought about if the maximum dischargeable amount of the ink is continuously discharged from all of the nozzles 15). The value of the duty, which is detected by the duty detecting section 51, is stored, for example, in RAM of the control unit 50.

The wait time determining section 53 includes a totalizing section 61 and a comparing section 62. The totalizing section 61 determines the totalized or added-up value S such that the values, which are obtained by multiplying, by 100, the values of the duties in the three continuous past passes provided just before, two times ago, and three times ago respectively as detected by the duty detecting section 52, i.e., the parameters P1, P2, P3 having the larger values thereof as the values of the duties are more increased, are totalized or added-up while giving the larger weights to the latter passes as compared with the former passes. That is, the parameters P1, P2, P3 are multiplied by the predetermined coefficients respectively, and the sum thereof is determined as the totalized value S. Specifically, the value, which is calculated in accordance with the expression (1), is determined as the totalized value S. As for the predetermined coefficients (1.0, 0.8, 0.64) in the numerical expression (1), those which correspond to the latter passes have the larger values. The way of determining the predetermined coefficients will be described later on.

$$S=(1.0\times P1)+(0.8\times P2)+(0.64\times P3) \quad (1)$$

The comparing section 62 compares the totalized value S which is determined by the totalizing section 61 with the threshold value L which is determined by the threshold value determining section 54 as described later on. If the totalized value S, which is obtained after the last pass, exceeds the threshold value L, then it is determined that the wait time is to be provided after the last pass, and the signal, which indicates that the wait time is to be provided, is outputted to the printing control section 51.

The threshold value determining section 54 determines the threshold value L which is the reference when it is determined in the wait time determining section 53 whether or not the wait time is provided based on the temperature detected by the temperature detecting unit 8 as described later on. Specifically, the threshold value L is 180 if the temperature, which is detected by the temperature detecting unit 8, is not less than 15° C. The threshold value L is 160 if the temperature is less than 15° C. That is, the lower the temperature detected by the temperature detecting unit 8 is, the smaller the threshold value L is. For example, the values of 180 and 160 of the threshold value L as described above are previously stored in ROM of the control unit 50.

Figure 5:
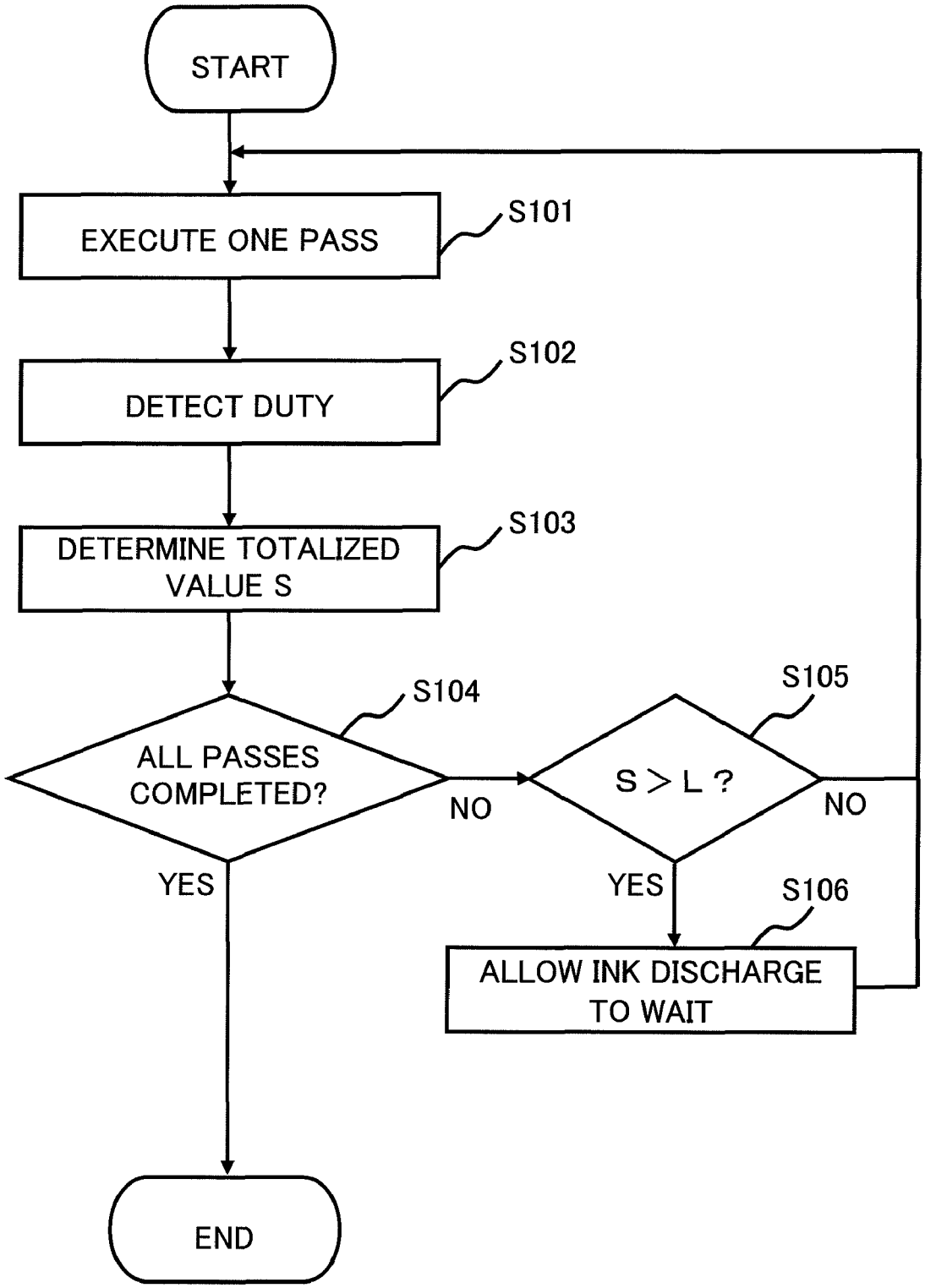
FIG. 5 shows a flow chart illustrating the flow of the control performed by the control unit shown in FIG. 1.

Next, an explanation will be made with reference to a flow chart shown in FIG. 5 about the operation for performing the printing in the printer 1 in accordance with the control of the control unit 50. The printing is performed on the recording paper P by discharging the inks from the nozzles 15 while reciprocatively moving the ink-jet head 4 in the scanning direction by the carriage 2 as described above in accordance with the control of the printing control section 51 in the printer 1.

At first, when the printing data is inputted into the printing control section 51, the printing control section 51 controls the driver IC 45, the carriage 2, and the transport rollers 7 to execute one pass (S101). After executing one pass, the duty detecting section 52 detects the duty of the pass executed just before (S102). Subsequently, the totalizing section 61 totalizes, as shown in the expression (1), the values of the parameters P1 to P3 corresponding to the duties in the passes executed just before, two times ago, and three times ago as detected by the duty detecting section 52, and thus the totalized value S is determined (S103). In this procedure, it is judged whether or not all of the passes are executed in order to print the inputted printing data (S104). If all of the passes are completed (S104: YES), the routine comes to an end. If all of the passes are not completed (S104: NO), a comparison is made by the comparing section 62 to judge whether the totalized value S determined by the totalizing section 61 is larger or smaller than the threshold value L determined by the threshold value determining section 54 (S105). If the totalized value S exceeds the threshold value L (S105: YES), the signal, which determines the provision of the wait time, is transmitted to the printing control section 51. When the concerning signal is inputted from the comparing section 62 into the printing control section 51, for example, the wait time, which is about 0.2 sec. that is the same as the time required for one pass, is provided after the corresponding pass in accordance with the control of the printing control section 51 (S106). After allowing the ink discharge to wait for the concerning wait time, the next one pass is executed (S101). If the totalized value S is not more than the threshold value L (S105: NO), the next one pass is executed without providing the wait time (S101).

An explanation will now be made about the reason why the wait time is provided as described above and the reason why it is determined whether or not the wait time is provided based on the values of the duties in the three past passes.

When the ink is discharged from the ink jet head 4 during the printing in the printer 1 as described above, then the ink, which is in the same amount as that of the ink decreased due to the discharge, is supplied from the ink cartridge 20 to the ink-jet head 4. However, the ink is not necessarily supplied to the ink-jet head 4 instantaneously when the ink is discharged from the ink-jet head 4, due to the viscosity of the ink and the flow passage resistance determined by the cross-sectional areas and the lengths of the ink-jet head 4 and the respective portions of the ink flow passage in the subtank 3 and the tube 6 for connecting the ink-jet head 4 and the ink cartridge 20. That is, any time difference arises between the discharge of the ink and the supply of the ink.

Therefore, when the discharge amount of the ink discharged from the ink-jet head 4 is large, for example, if the value of the duty is high in the past pass, then the negative pressure of the ink is increased in the ink-jet head 4. If the discharge of the ink is further continued from the ink-jet head 4 in this state, then the negative pressure of the ink is further increased, the meniscus in the nozzle is destroyed, and the air flows into the ink-jet head 4. That is, it is feared that the ink supply shortage may arise in the ink-jet head 4, and it is impossible to normally discharge the ink from the nozzle 15.

Accordingly, in this embodiment, as described above, the wait time is provided after the pass, and the next pass is started after the ink is supplied to the ink-jet head 4. Accordingly, the supply shortage of the ink with respect to the ink-jet head 4 as described above is avoided. However, if the wait time as described above is uniformly provided after all of the passes, any unnecessary wait time is provided even when the negative pressure of the ink is not large in the ink-jet head 4. The printing speed is lowered.

Therefore, it is preferable that the wait time is provided only when the necessary amount of the ink is not supplied to the ink-jet head 4. However, for this purpose, it is necessary to judge whether or not the necessary amount of the ink is supplied to the ink-jet head 4.

The negative pressure of the ink is more increased in the ink-jet head 4 when the ink is continuously discharged, as the supply amount of the ink with respect to the ink-jet head 4 is more decreased. Therefore, if it is possible to directly detect the pressure in the ink-jet head 4, it is possible to determine whether or not the wait time is provided based on the magnitude or extent of the detected pressure. However, the ink flow passage in the ink-jet head 4 is generally a small flow passage. Therefore, it is not practical that any sensor or the like is distinctly provided to directly detect the pressure in the ink-jet head 4.

Accordingly, it is conceived to determine whether or not the wait time is provided by using the value of the duty in each of the passes corresponding to the discharge amount of the ink discharged from the ink-jet head 4. For example, it is most easily thought of to determine whether or not the wait time is provided based on only the value of the duty in the last pass, for example, such that the wait time is provided if the value of the duty in the last pass exceeds a predetermined threshold value.

However, when the printing is performed on the recording paper P by discharging the ink from the nozzles 15 while reciprocatively moving the ink-jet head 4 in the scanning direction, even if the value of the duty in the last pass is high, such a situation that the ink cannot be discharged due to the decrease in the ink in the ink-jet head 4 is not provided immediately. For example, when the passes, in which the values of the duties are high, are continued, then the negative pressure of the ink is gradually increased in the ink-jet head 4, and the ink cannot be finally discharged from the ink jet head 4. In other words, the negative pressure of the ink in the ink-jet head 4 is not determined by only the value of the duty in the last pass, but the negative pressure of the ink in the ink jet head 4 also depends on the values of the duties in the more previous passes.

This situation will be explained in further detail below. As described above, when the ink supply amount to the ink-jet head 4 is decreased, if the ink is discharged continuously, then the negative pressure of the ink is increased in the ink jet head 4. On the other hand, the ink flows into the ink-jet head 4, and thus the negative pressure of the ink is gradually decreased in accordance with the elapse of time. The rate of the decrease in the negative pressure of the ink differs depending on, for example, the structure of the flow passage. However, for example, it is empirically known that the negative pressure of the ink, which has been generated in the previous pass, is decreased to about 80% by every one pass, when the time, which is required for one pass, is about 0.2 sec. in the ink-jet head 4 having a certain flow passage structure.

In the case of this example, the negative pressure of the ink, which is generated in the last pass, is added-up to the negative pressures of the ink generated in the passes executed before the last pass including, for example, the negative pressure of the ink which is generated in the pass executed two times ago and which is decreased to about 80% and the negative pressure of the ink which is generated in the pass executed three times ago and which is decreased to about 64% ($=0.8^2\times100$), in the ink-jet head 4 after the last pass. In this way, the negative pressure of the ink, which is provided in the ink-jet head 4 after the last pass, depends on not only the value of the duty in the last pass but also the values of the duties in the previous passes. In other words, the value of the duty, which is provided in the last pass, does not correctly correspond to the negative pressure of the ink in the ink-jet head 4.

Therefore, if it is determined whether or not the wait time is provided depending on only the value of the duty in the last pass, it is necessary that the threshold value should be set by setting the most severe condition in order to supply the ink, for example, assuming that the passes, in which the values of the duties are high, are continued before the last pass.

However, for example, when the passes, in which the values of the duties are small, are continued before the last pass, any unnecessary wait time is provided. As a result, the printing speed of the printer 1 is lowered.

Accordingly, in this embodiment, as described above, the wait time is provided after such a pass that the totalized value S, which is obtained by totalizing the parameters P1 to P3 corresponding to the duties in the passes executed just before, two times ago, and three times ago, exceeds the threshold value L.

In this case, the totalized value S is obtained by totalizing the values of the parameters P1 to P3 in the three continuing past passes (past continuing discharge opportunities including the last discharge opportunity). Therefore, the totalized value S is correlated with the degree of the decrease in the ink in the ink-jet head 4.

Further, as described above, the negative pressures of the ink in the ink jet head 4, which have been generated in the past passes, are decreased in accordance with the elapse of time. Therefore, the values of the duties, which are provided in the later passes, more greatly relate to the negative pressure of the ink in the ink-jet head 4. In this embodiment, when the parameters P1 to P3 are totalized or added-up to determine the totalized value S, the larger weights are applied to the values of the parameters in relation to the latter passes as compared with the former passes as described above. Therefore, the totalized value S more correctly corresponds to the negative pressure of the ink in the ink-jet head 4.

Therefore, if the necessary amount of the ink is not supplied to the ink-jet head 4, then the totalized value S exceeds the threshold value L, and the wait time is provided after the pass. Therefore, it is possible to avoid the ink supply shortage with respect to the ink jet head 4. On the other hand, if the negative pressure of the ink is not large in the ink jet head 4, then the totalized value S does not exceed the threshold value L, and any unnecessary wait time is not provided. Therefore, it is possible to suppress the decrease in the printing speed as far as possible.

In this embodiment, the values of the weighing coefficients with respect to the values of the duties, which are provided for the passes executed just before, two times ago, and three times ago, are 1.0, 0.8, and 0.64 ($=0.8^2$) respectively in the expression (1) to calculate the totalized value S in conformity with the fact that the negative pressure of the ink in the ink-jet head 4 is decreased to about 80% during the period of time required for one pass as in the example described above. However, the weighing coefficients can be appropriately changed in conformity with the extent of the decrease in the negative pressure of the ink in the ink-jet head 4 in accordance with the elapse of time.

The lower the temperature is, the more hardly the ink flows (flow resistance is increased) due to the increase in the viscosity thereof. Therefore, the lower the ink temperature is, the smaller the ink supply amount to the ink-jet head 4 is.

However, in this embodiment, the lower the temperature detected by the temperature detecting unit 8 is, the smaller the threshold value L is. Therefore, when the necessary amount of the ink is not supplied to the ink jet head 4, then the totalized value S reliably exceeds the threshold value L, and the wait time is provided after the pass. Therefore, it is possible to reliably avoid the supply shortage of the ink to be supplied to the ink-jet head 4.

The threshold value L and a temperature which serves as the boundary to determine the threshold value L to be any one of 180 and 160 can be appropriately changed in conformity with, for example, the degree of the change of the viscosity of the ink depending on the temperature change.

Table 1 shows examples of the values of the parameters P1 to P3 in each of the passes, the totalized value S in each of the passes, and the presence or absence of the wait time to be provided after each of the passes when the printer 1 operated as described above to perform the printing.

TABLE 1

| | Parameter | | | | Wait time | |
|---|---|---|---|---|---|---|
| | P3 (three times ago) | P2 (two times ago) | P1 (just before) | Totalized value S | not less than 15° C. (L = 180) | less than 15° C. (L = 160) |
| 1 | 0 | 0 | 10 | 10 | not provided | not provided |
| 2 | 0 | 10 | 30 | 38 | not provided | not provided |
| 3 | 10 | 30 | 80 | 110.4 | not provided | not provided |
| 4 | 30 | 80 | 90 | 173.2 | not provided | provided |
| 5 | 80 | 90 | 60 | 183.2 | provided | provided |
| 6 | 90 | 60 | 20 | 125.6 | not provided | not provided |
| 7 | 60 | 20 | 80 | 134.4 | not provided | not provided |
| 8 | 20 | 80 | 70 | 146.8 | not provided | not provided |
| 9 | 80 | 70 | 60 | 167.2 | not provided | provided |

As shown in Table 1, in this example, the values of the duties, which are provided in the nine continuing passes, are 10%, 30%, 80%, 90%, 60%, 20%, 80%, 70%, and 60% in an order starting from the former one. In this example, it is assumed that the negative pressure of the ink is not generated in the ink jet head 4 before the first pass.

In this case, as shown in Table 1, if the temperature detected by the temperature detecting unit 8 is not less than 15° C., the totalized value S exceeds the threshold value L (=180) only after the fifth pass. If the temperature is less than 15° C., the totalized value S exceeds the threshold value L (=160) only after the fourth, fifth, and ninth passes. The wait time is provided after these passes.

Next, an explanation will be made about a modified embodiment in which various modifications are applied to the embodiment of the present invention. However, the components or parts, which are constructed in the same manner as those of the embodiment of the present invention, are designated by the same reference numerals, any explanation of which will be appropriately omitted.

In the embodiment described above, the threshold value L determined by the threshold value determining section 54 is changed depending on the temperature detected by the temperature detecting unit 8. However, the present invention is not limited thereto. For example, in one modified embodiment (first modified embodiment), as shown in Table 2, the threshold value L is constant (=160) irrelevant to the temperature detected by the temperature detecting unit 8. In this arrangement, the wait time determining section 53 determines the length of the wait time in addition to the determination of whether or not the wait time is provided. If the totalized value S exceeds the threshold value L, the wait time is provided. Further, if the temperature, which is detected by the temperature detecting unit 8, is not less than 15° C., the length of the wait time is T1 (for example, about 0.2 sec. which is the same as the time required for one pass). If the temperature is less than 15° C., the period of the wait time is T2 (for example, about 0.4 sec. required for two passes) longer than T1. That is, the lower the temperature of the ink is, the longer the period of the wait time is.

TABLE 2

| | Parameter | | | | Wait time (L = 160) | |
|---|---|---|---|---|---|---|
| | P3 (three times ago) | P2 (two times ago) | P1 (just before) | Totalized value S | not less than 15° C. | less than 15° C. |
| 1 | 0 | 0 | 10 | 10 | not provided | not provided |
| 2 | 0 | 10 | 30 | 38 | not provided | not provided |
| 3 | 10 | 30 | 80 | 110.4 | not provided | not provided |
| 4 | 30 | 80 | 90 | 173.2 | T1 | T2 |
| 5 | 80 | 90 | 60 | 183.2 | T1 | T2 |
| 6 | 90 | 60 | 20 | 125.6 | not provided | not provided |
| 7 | 60 | 20 | 80 | 134.4 | not provided | not provided |
| 8 | 20 | 80 | 70 | 146.8 | not provided | not provided |
| 9 | 80 | 70 | 60 | 167.2 | T1 | T2 |

In this case, the wait time is prolonged, when the viscosity of the ink is increased due to the decreased in the temperature, and the ink supply amount with respect to the ink-jet head 4 is decreased. Therefore, if the necessary amount of the ink is not supplied to the ink-jet head 4, the wait time, which is required to reliably supply the ink to the ink-jet head 4, is provided. Therefore, it is possible to reliably avoid the ink supply shortage with respect to the ink-jet head 4. Further, any unnecessary wait time is not provided, and it is possible to suppress the decrease in the printing speed as far as possible.

In the first modified embodiment, the period of the wait time is determined based on the temperature detected by the temperature detecting unit 8. However, the present invention is not limited thereto. For example, the wait time may be more prolonged as the totalized value S is larger.

The larger the totalized value S is, the larger the negative pressure of the ink in the ink-jet head 4 is. Therefore, when the wait time is more prolonged as the totalized value S is larger, the wait time is provided to supply the ink in the amount necessary to dissolve the negative pressure of the ink. Therefore, it is possible to reliably avoid the ink supply shortage with respect to the ink jet head 4. Further, any unnecessary wait time is not provided, and it is possible to suppress the decrease in the printing speed as far as possible.

In the embodiment described above, the larger weights are applied to the latter duties when the parameters P1 to P3 are totalized to calculate the totalized value S. However, the present invention is not limited thereto. As shown in Table 3, the value, which is obtained by totalizing the values of the parameters P1 to P3 as they are, may be used as the totalized value S.

TABLE 3

| | Parameter | | | | Wait time | |
|---|---|---|---|---|---|---|
| | P3 (three times ago) | P2 (two times ago) | P1 (just before) | Totalized value S | not less than 15° C. (L = 180) | less than 15° C. (L = 160) |
| 1 | 0 | 0 | 10 | 10 | not provided | not provided |
| 2 | 0 | 10 | 30 | 40 | not provided | not provided |
| 3 | 10 | 30 | 80 | 120 | not provided | not provided |
| 4 | 30 | 80 | 90 | 200 | provided | provided |
| 5 | 80 | 90 | 60 | 230 | provided | provided |
| 6 | 90 | 60 | 20 | 170 | not provided | provided |
| 7 | 60 | 20 | 80 | 160 | not provided | not provided |
| 8 | 20 | 80 | 70 | 170 | not provided | provided |
| 9 | 80 | 70 | 60 | 210 | provided | provided |

Also in this case, the totalized value S is obtained by totalizing the values of the parameters P1 to P3 in the three continuing past passes. Therefore, the totalized value S correctly corresponds to the extent of the negative pressure of the ink in the ink-jet head 4. Therefore, it is possible to suppress the ink supply shortage with respect to the ink-jet head 4 and the decrease in the printing speed to some extent.

In the embodiment described above, all of the values of the weighing coefficients for the parameters P1 to P3 are constant. However, the present invention is not limited thereto. If the wait time is provided after the pass executed two times ago or after the pass executed three times ago, the negative pressures of the ink in the ink jet head 4, which have been generated in the pass executed two times ago and the pass executed three times ago, are decreased during the concerning wait time as well. Accordingly, the totalized value S may be calculated by decreasing the weighing coefficients for the parameters P2, P3 if the wait time has been provided after the pass executed two times ago and the weighing coefficient for the parameter P3 if the wait time has been provided after the pass executed three times ago respectively as compared with the case in which no wait time has been provided. In this case, the values of the coefficients for applying the weights to the parameters P2, P3 may be determined, for example, depending on the period of the wait time.

In the embodiment described above, the ratio of the amount of the actually discharged ink, which is calculated with respect to the maximum discharge amount of the ink to be discharged from the ink-jet head 4 in each of the passes, is regarded as the duty. It is determined whether or not the wait time is provided after the pass based on the value of the duty. However, the present invention is not limited thereto.

For example, in the printer 1, the operation (ink discharge operation), in which the ink is discharged from the plurality of nozzles 15, is repeated a plurality of times in each of the passes as described above. However, the ratio of the amount of the actually discharged ink, which is calculated with respect to the maximum discharge amount of the ink to be discharged from the ink jet head 4 in each of the ink discharge operations (discharge opportunities), may be regarded as the duty. It is also allowable to determine whether or not the wait time is provided after each of the ink discharge operations based on the value of the duty.

Alternatively, the ratio of the amount of the actually discharged ink, which is calculated with respect to the maximum ink discharge amount during the period (discharge opportunity) for continuously performing the ink discharge operations a plurality of predetermined times while moving the ink jet head 4 by a predetermined distance different from the distance ranging from one end to the other end of the printing range in relation to the scanning direction, may be regarded as the duty. It is also allowable to determine whether or not the wait time is provided after continuously performing the ink discharge operations the plurality of predetermined times based on the value of the duty.

In the embodiment described above, the ink jet head 4 is the so-called serial head in which the ink-jet head 4 is reciprocatively moved in the scanning direction together with the carriage 2. However, the ink-jet head may be a so-called line head which is fixed to the printer 1 and which extends over the entire length of the recording paper P in relation to the scanning direction. In this case, the printing is performed on the recording paper P such that the operation (ink discharge operation), in which the inks are discharged from a plurality of nozzles of the line head, is repeatedly performed while transporting the recording paper P in the paper feeding direction by the transport rollers 7.

When the ink-jet head is the line head, for example, it is also allowable to use, as the duty, the ratio of the amount of the actually discharged ink with respect to the maximum ink discharge amount in the discharge opportunity in which the inks are discharged from the plurality of nozzles to perform the printing on one sheet of the recording paper P. It is also allowable to determine whether or not the wait time is provided after the execution of the printing on one sheet of the recording paper P, i.e., after the discharge opportunity based on the value of the duty.

Alternatively, it is also allowable to use, as the duty, the ratio of the amount of the actually discharged ink with respect to the maximum discharge amount of the ink to be discharged from the ink jet head in the period (discharge opportunity) in which the ink discharge operation as described above is continuously performed a plurality of predetermined times. It is also allowable to determine whether or not the wait time is provided after the continuous execution of the liquid discharge operation the plurality of predetermined times based on the value of the duty.

In the embodiment described above, the totalized value S is calculated by totalizing or adding-up the values of the parameters P1 to P3 in the three continuous past passes. However, the totalized value S may be calculated by totalizing the values of the parameters in the two continuous passes or the four or more passes provided that the passes include the last pass. In this case, it is necessary that the threshold value L should be determined in conformity with the number of the values of the parameters to be totalized.

In the embodiment described above, the values of the parameters are obtained by multiplying the values of the duties in each of the passes by 100. However, the present invention is not limited thereto. The values of the parameters may be determined in accordance with any other method provided that the larger the value of the duty is, the larger the value of the determined parameter is.

In the embodiment described above, it is determined whether or not the wait time is provided depending on whether or not the totalized value S exceeds the threshold value L. However, the present invention is not limited thereto. For example, the threshold values may be determined individually for the passes executed just before, two times ago, and three times ago. It is also allowable to determine whether or not the wait time is provided after the last pass in accordance with any other method based on the values of the duties in the two or more continuous past passes including the last pass, for example, such that the wait time is provided if the values of the duties exceed the threshold values in the two or more passes.

In the foregoing description, the movement of the carriage 2 is stopped when the ink-jet head 4 is allowed to wait. However, the ink jet head 4 may be allowed to wait by prohibiting the ink jet head 4 from discharging the inks while moving the carriage 2. In this case, the ink jet head 4 may be allowed to wait while moving the carriage 2 by gently performing the deceleration of the carriage 2 after the last pass and the acceleration upon the start of the recording to be performed thereafter.

In the embodiment and the modified embodiment described above, the wait time determining section 53 determines whether or not the wait time is provided depending on whether or not the totalized value S of the parameters exceeds the threshold value L. However, the wait time may always be provided after each of the discharge opportunities. For example, a first wait time and a second wait time which is shorter than the first wait time may be set previously. When the totalized value S of the parameters exceeds the threshold value L, the wait time determining section 53 may determine the wait time to be the first wait time, and when the totalized value S of the parameters is not greater than the threshold value L, the wait time determining section 53 may determine the wait time to be the second wait time. Even in this case, since the wait time is determined to be the second wait time which is shorter than the first wait time when the totalized value S of the parameters is not greater than the threshold value L, it is possible to suppress the decrease in the operation speed of the printer.

In the embodiment and the modified embodiment described above, the duty detecting section 52 detects the duty of the ink-jet head 4 irrelevant to the color of the ink to be discharged, and the wait time determining section 53 determines the wait time irrelevant to the color of the ink to be discharged as well. However, the method for detecting the duty and the method for determining the wait time are not limited thereto. For example, the duty detecting section may detect the duty for each of the colors of the inks to be discharged, and the wait time determining section 53 may determine the wait time for each of the colors of the inks to be discharged. In this case, if it is determined by the wait time detecting section to set the wait time for any one of the colors of the inks, the control unit may allow the ink-jet head to wait after the last discharge opportunity. If it is determined to set the wait time for any one of the colors of the inks, and the ink of the concerning color is not discharged in the next discharge opportunity, then the control unit may execute the discharge in the next discharge opportunity without allowing the ink-jet head to wait after the last discharge opportunity, for the following reason. That is, the ink of the concerning color is not discharged in the next discharge opportunity. Therefore, the ink of the concerning color is supplied to the ink-jet head during the next discharge opportunity, and the negative pressure of the ink of the concerning color can be dissolved. In this case, it is possible to omit the wait time which would be otherwise required to supply the ink of the color not discharged in the next discharge opportunity. It is possible to suppress the decrease in the operation speed of the printer.

In the embodiment and the modified embodiment described above, the ink-jet head 4 is the so-called serial head which is reciprocatively movable in the scanning direction together with the carriage 2. The inks are discharged while making the movement in one direction from one end to the other end of the printing range in relation to the scanning direction, and the inks are also discharged when the movement is made in the opposite direction. However, the ink discharge system is not limited thereto. It is also allowable to adopt such a discharge system that the inks are discharged only when the movement is effected in one direction from the one end to the other end of the printing range in relation to the scanning direction and the inks are not discharged when the movement is effected in the opposite direction. In this case, when the movement is effected in the opposite direction, the ink-jet head does not discharge the inks. Therefore, the inks can be supplied to the ink-jet head to some extent during the period in which the ink-jet head is moved in the opposite direction. Therefore, it is possible to shorten the wait time for supplying the inks to the ink-jet head as compared with the case in which the inks are also discharged when the movement is effected in the opposite direction.

The embodiment and the modified embodiment explained above are illustrative of the exemplary case in which the present teaching is applied to the printer 1 wherein the inks are supplied to the ink-jet head 4 via the tubes 6 and the subtanks 3 from the ink cartridges 20 attached to the cartridge attachment section 5. However, the ink supply system is not limited thereto. For example, the present teaching is applicable to a printer of such a system that the ink cartridges are directly attached to the carriage for carrying the ink-jet head, and the inks are supplied from the ink cartridges to the ink-jet head without using the tubes. In this case, the inks are supplied without using the tubes. Therefore, the flow passage resistance is small as compared with the case in which the inks are supplied via the tubes. It is considered that the time difference, which is generated between the ink discharge and the supply, is also decreased. Therefore, the wait time, which is to be provided if the totalized value of the values of the parameters exceeds the threshold value, may be shorter than that to be provided when the inks are supplied via the tubes.

The foregoing description is illustrative of the exemplary case in which the present teaching is applied to the printer which is provided with the ink jet head for discharging the inks from the nozzles. However, the present invention is not limited thereto. The present invention is also applicable to a liquid discharge apparatus which is provided with a liquid discharge head for discharging any liquid other than the ink from nozzles.

What is claimed is:

1. A liquid discharge apparatus which discharges a liquid in each of a plurality of continuing discharge opportunities, the liquid discharge apparatus comprising:

a liquid discharge head which discharges the liquid from a plurality of nozzles;

a controller which controls the liquid discharge head to discharge the liquid from the plurality of nozzles;

a duty detecting section which detects a value of a duty which is a ratio of a discharge amount of the liquid discharged from the liquid discharge head with respect to a maximum discharge amount of the liquid to be discharged from the liquid discharge head in each of the discharge opportunities; and a wait time determining section which determines whether or not a wait time, in which the liquid is not discharged, is provided after each of the discharge opportunities, wherein the wait time determining section determines whether or not the wait time is provided based on the values of the duties which are detected by the duty detecting section in past continuing discharge opportunities including the last discharge opportunity;

wherein the controller controls the liquid discharge head to wait for the wait time after the last discharge opportunity when the wait time determining section determines that the wait time is to be provided;

wherein the wait time determining section determines a value of a parameter in each of the discharge opportunities based on the value of the duty in each of the discharge opportunities detected by the duty detecting section so that the value of the parameter is greater as the detected value of the duty is greater;

wherein the wait time determining section determines that the wait time is to be provided, when a total value, which is obtained by totalizing the values of the respective parameters in the past continuing discharge opportunities including the last discharge opportunity, exceeds a predetermined threshold value; and wherein, when the values of the respective parameters are totalized, the wait time determining section multiplies the value of the parameter corresponding to a first discharge opportunity, among the discharge opportunities, by a first coefficient, and multiplies the value of the parameter corresponding to a second discharge opportunity which is after the first discharge opportunity by a second coefficient which is greater than the first coefficient.

2. The liquid discharge apparatus according to claim 1, further comprising:

a moving section which is controlled by the controller to move the liquid discharge head in a scanning direction;

wherein the controller controls the liquid discharge head and the moving section in each of the discharge opportunities so that the liquid is discharged from the plurality of nozzles while moving the liquid discharge head in the scanning direction by the moving section.

3. The liquid discharge apparatus according to claim 1;

wherein the liquid discharge head extends in a predetermined direction, the liquid discharge head is fixed to the liquid discharge apparatus, and the nozzles are arranged in the predetermined direction.

4. The liquid discharge apparatus according to claim 1;

wherein, when the wait time determining section determines whether or not the wait time is provided after the last discharge opportunity;

wherein if the wait time was not provided in a discharge opportunity which is before the last discharge opportunity, the wait time determining section multiplies the value of the parameter corresponding to the discharge opportunity by a first coefficient; and wherein, if the wait time was provided in the discharge opportunity, the wait time determining section multiplies the value of the parameter corresponding to the discharge opportunity by a second coefficient which is smaller than the first coefficient.

5. A liquid discharge apparatus which discharges a liquid in each of a plurality of continuing discharge opportunities, the liquid discharge apparatus comprising:

a liquid discharge head which discharges the liquid from a plurality of nozzles;

a controller which controls the liquid discharge head to discharge the liquid from the plurality of nozzles;

a duty detecting section which detects a value of a duty which is a ratio of a discharge amount of the liquid discharged from the liquid discharge head with respect to a maximum discharge amount of the liquid to be discharged from the liquid discharge head in each of the discharge opportunities; and a wait time determining section which determines whether or not a wait time, in which the liquid is not discharged, is provided after each of the discharge opportunities, wherein the wait time determining section determines whether or not the wait time is provided based on the values of the duties which are detected by the duty detecting section in past continuing discharge opportunities including the last discharge opportunity;

wherein the controller controls the liquid discharge head to wait for the wait time after the last discharge opportunity when the wait time determining section determines that the wait time is to be provided;

wherein the wait time determining section determines a value of a parameter in each of the discharge opportunities based on the value of the duty in each of the discharge opportunities detected by the duty detecting section, so that the value of the parameter is greater as the detected value of the duty is greater;

wherein the wait time determining section determines that the wait time is to be provided, when a total value, which is obtained by totalizing the values of the respective parameters in the past continuing discharge opportunities including the last discharge opportunity, exceeds a predetermined threshold value;

wherein the liquid discharge apparatus further comprises:

a temperature detecting section which detects a temperature of the liquid; and a threshold value determining section which determines the threshold value; and wherein the threshold value determining section determines the threshold value so that the threshold value is smaller as the temperature, which is detected by the temperature detecting section, is lower.

6. The liquid discharge apparatus according to claim 1;

wherein the wait time determining section determines length of the wait time when the wait time determining section determines that the wait time is to be provided.

7. The liquid discharge apparatus according to claim 6, further comprising:

a temperature detecting section which detects a temperature of the liquid;

wherein the wait time determining section determines the length of the wait time so that the length of the wait time is longer as the temperature, which is detected by the temperature detecting section, is lower.

8. A liquid discharge apparatus which discharges a liquid in each of a plurality of continuing discharge opportunities, the liquid discharge apparatus comprising:

a liquid discharge head which discharges the liquid from a plurality of nozzles;

a controller which controls the liquid discharge head to discharge the liquid from the plurality of nozzles;

a duty detecting section which detects a value of a duty which is a ratio of a discharge amount of the liquid discharged from the liquid discharge head with respect to a maximum discharge amount of the liquid to be discharged from the liquid discharge head in each of the discharge opportunities; and a wait time determining section which determines whether or not a wait time, in which the liquid is not discharged, is provided after each of the discharge opportunities, wherein the wait time determining section determines whether or not the wait time is provided based on the values of the duties which are detected by the duty detecting section in past continuing discharge opportunities including the last discharge opportunity;

wherein the controller controls the liquid discharge head to wait for the wait time after the last discharge opportunity when the wait time determining section determines that the wait time is to be provided;

wherein the liquid includes a plurality of color inks;

wherein the liquid discharge head discharges the plurality of color inks;

wherein the duty detecting section detects the value of the duty for each of the color inks;

wherein the wait time determining section determines whether or not the wait time is provided for each of the color inks;

wherein the controller controls the liquid discharge head to wait after the last discharge opportunity, when the wait time determining section determines that the wait time is to be provided for any one of the plurality of color inks; and wherein the controller controls the liquid discharge head such that the liquid discharge head does not wait after the last discharge opportunity, when the one of the plurality of color inks is not discharged in the next discharge opportunity, even if the wait time determining section determines that the wait time is to be provided for the one of the plurality of color inks.

9. A liquid discharge apparatus which discharges a liquid in each of a plurality of continuing discharge opportunities, the liquid discharge apparatus comprising:

a liquid discharge head which discharges the liquid from a plurality of nozzles;

a controller which controls the liquid discharge head to discharge the liquid from the plurality of nozzles;

a duty detecting section which detects a value of a duty which is a ratio of a discharge amount of the liquid discharged from the liquid discharge head with respect to a maximum discharge amount of the liquid to be discharged from the liquid discharge head in each of the discharge opportunities; and a wait time determining section which determines a wait time, in which the liquid is not discharged, to be a first wait time or a second wait time which is not shorter than zero and shorter than the first wait time after each of the discharge opportunities, wherein the wait time determining section determines the wait time to be the first wait time or the second wait time based on the values of the duties which are detected by the duty detecting section in past continuing discharge opportunities including the last discharge opportunity; and wherein the controller controls the liquid discharge head to wait for the wait time determined by the wait time determining section after the last discharge opportunity, when the wait time determining section determines the wait time.

10. The liquid discharge apparatus according to claim 9, further comprising:

a moving section which is controlled by the controller to move the liquid discharge head in a scanning direction;

wherein the controller controls the liquid discharge head and the moving section in each of the discharge opportunities so that the liquid is discharged from the plurality of nozzles while moving the liquid discharge head in the scanning direction by the moving section.

11. The liquid discharge apparatus according to claim 9;

wherein the liquid discharge head extends in a predetermined direction, the liquid discharge head is fixed to the liquid discharge apparatus, and the nozzles are arranged in the predetermined direction.

12. The liquid discharge apparatus according to claim 9;

wherein the wait time determining section determines a value of a parameter in each of the discharge opportunities based on the value of the duty in each of the discharge opportunities detected by the duty detecting section, so that the value of the parameter is greater as the detected value of the duty is greater and;

wherein the wait time determining section determines the wait time to be the first wait time, when a total value, which is obtained by totalizing the values of the respective parameters in the past continuing discharge opportunities including the last discharge opportunity, exceeds a predetermined threshold value; and wherein, when the total value is not greater than the threshold value, the wait time determining section determines the wait time to be the second wait time.

13. The liquid discharge apparatus according to claim 12;

wherein, when the values of the respective parameters are totalized, the wait time determining section multiplies the value of the parameter corresponding to a first discharge opportunity, among the discharge opportunities, by a first coefficient, and multiplies the value of the parameter corresponding to a second discharge opportunity which is after the first discharge opportunity by a second coefficient which is greater than the first coefficient.

* * * * *